US005288248A

United States Patent [19]

Chen

[11] Patent Number: 5,288,248

[45] Date of Patent: Feb. 22, 1994

[54] TOTALLY SHIELDED DIN CONNECTOR

[75] Inventor: Chin Y. Chen, Hsin-Chuang, Taiwan

[73] Assignee: Foxconn International, Sunnyvale, Calif.

[21] Appl. No.: 784,459

[22] Filed: Oct. 28, 1991

[51] Int. Cl.[5] ..... H01R 13/648

[52] U.S. Cl. ..... 439/609; 439/607; 439/108

[58] Field of Search ..... 439/607-610, 439/92, 95, 101, 108, 675

[56] References Cited

U.S. PATENT DOCUMENTS

| | | | |
|---|---|---|---|
| 2,870,424 | 12/1954 | Franz . | |
| 3,141,924 | 3/1962 | Forney . | |
| 3,219,961 | 2/1963 | Bailey et al. . | |
| 3,441,659 | 2/1967 | Laudig et al. . | |
| 3,648,222 | 3/1972 | Cowmeadow | 339/14 R |
| 3,694,793 | 9/1972 | Concelman | 339/177 R |
| 3,986,765 | 10/1976 | Shaffer et al. | 339/90 R |
| 4,269,472 | 5/1981 | Shaffer et al. | 339/223 R |
| 4,307,926 | 12/1981 | Smith | 339/177 R |
| 4,310,213 | 1/1982 | Fetterolf et al. | 339/106 M |
| 4,316,647 | 2/1982 | Bailey et al. | 339/91 R |
| 4,337,989 | 7/1982 | Asick et al. | 339/143 R |
| 4,361,375 | 11/1982 | Bailey et al. | 339/91 R |
| 4,392,708 | 7/1983 | Bailey et al. | 339/182 R |
| 4,398,784 | 8/1983 | Takihara | 339/182 R |
| 4,548,455 | 10/1985 | Ezure | 339/45 M |
| 4,568,133 | 2/1986 | Amano et al. | 339/14 R |
| 4,611,878 | 9/1986 | Hall et al. | 339/106 M |
| 4,623,211 | 11/1986 | Dambach et al. | 339/143 R |
| 4,634,208 | 1/1987 | Hall et al. | 339/143 R |
| 4,637,669 | 1/1987 | Tajima | 339/14 R |
| 4,639,066 | 1/1987 | Shimamiya et al. | 339/132 R |
| 4,679,879 | 7/1987 | Triner et al. | 439/425 |
| 4,737,124 | 4/1988 | Ezure et al. | 439/610 |
| 4,741,708 | 5/1988 | Yoshida et al. | 439/483 |
| 4,842,554 | 6/1989 | Cosmos et al. | 439/609 |
| 4,842,555 | 6/1989 | Cosmos et al. | 439/609 |
| 4,894,026 | 1/1990 | Dixon et al. | 439/609 |
| 4,908,335 | 3/1990 | Cosmos et al. | 439/79 |
| 4,913,664 | 4/1990 | Dixon et al. | 439/607 |
| 4,925,405 | 5/1990 | Wei et al. | 439/608 |
| 4,936,795 | 6/1990 | Kawai et al. | 439/609 |
| 4,938,714 | 7/1990 | Kawai et al. | 439/607 |
| 4,946,400 | 8/1990 | Kawai et al. | 439/79 |
| 4,960,388 | 10/1990 | Frantz et al. | 439/404 |
| 4,960,389 | 10/1990 | Frantz et al. | 439/404 |
| 4,983,127 | 1/1991 | Kawai et al. | 439/79 |
| 5,007,862 | 4/1991 | Defibaugh et al. | 439/79 |
| 5,017,158 | 5/1991 | Liu et al. | 439/607 |
| 5,022,871 | 6/1991 | Sekiguchi | 439/609 |
| 5,035,651 | 7/1991 | Dixon et al. | 439/609 |
| 5,037,330 | 8/1991 | Fulponi et al. | 439/607 |
| 5,041,022 | 8/1991 | Sekiguchi et al. | 439/609 |
| 5,083,945 | 1/1992 | Miskin et al. | 439/607 |
| 5,094,627 | 3/1992 | Uekido | 439/610 |

*Primary Examiner*—Larry I. Schwartz
*Assistant Examiner*—Hien D. Vu
*Attorney, Agent, or Firm*—Lyon & Lyon

[57] ABSTRACT

A totally shielded connector includes a cuboid insulator having an annular recess and a cylindrical portion incorporating a plurality of contacts for coupling with a tubular external shield of a plug. The shield is comprised of two separate shells for covering five faces of the insulator except the face through which contacts extend for reception in apertures in a base on which the connector is to be mounted. One U-shaped front shell defines a front wall and two side walls and a second L-shaped rear shell defines a top wall and a rear wall. These two shells are fastened to each other, and to the insulator. Overlapping structures are positioned on a portion of all of the interconnection edges between the two shells to substantially eliminate any gaps in the shielding.

12 Claims, 2 Drawing Sheets

TOTALLY SHIELDED DIN CONNECTOR

BACKGROUND OF THE INVENTION

1. Field of the Invention

The field of the present invention relates to an electrical connector. More particularly, the field of the present invention relates to a totally shielded DIN connector.

2. The Prior Art

Electromagnetic interference or high frequency and radio frequency signals are often radiated or conducted to susceptible electronic equipment and interfere with the performance of that equipment. Electromagnetic interference sources includes sparks, lightning, radar, radio and TV transmission signals, brush motors and line transients. Sparks from a static discharge often are sources of electromagnetic Interference. By means of line conduction or by propagation through the air, electromagnetic interference may induce undesirable voltage signals in electronic equipment. Such interference is especially prevalent at connection devices such as in a DIN type connector.

In order to prevent electromagnetic interference from occurring at a connector and to keep a proper signal transmission from one or more devices utilizing the connector, two methods are commonly used. A first method utilizes a filter device coupling the connector's contacts in order to filter undesired signals from the circuit itself. The second method utilizes a metal shield to cover the outer surfaces of the connector for preventing external electromagnetic interference from penetrating into the insulator of the connector. The present device relates to the second method, that is an improved outer shielding of the connector for substantially eliminating the adverse effects of electromagnetic interference.

Conventional outer shielding for connectors involves two types of structures. A first group utilizes two separate shields, an inner shell and an outer shell, for coupling the connector. Examples of this type of connector include U.S. Pat. Nos. 4,637,669, 4,894,027, 4,913,664, 4,936,795, 4,938,714, 4,946,400, 5,017,158, 5,035,615. The first group of patents as exemplified in U.S. Pat. No. 4,637,669 fails to achieve an adequate shielding effect from electromagnetic interference. For example, the '669 patent lacks a front shield for protecting the contact accommodating apertures which make contact with another connector or device. Because the electromagnetic interference is especially prevalent and may concentrate at the point of connection, this type of shield is inadequate to provide the required shielding effect.

Another group of conventional connectors utilizes a one-piece shield and includes U.S. Pat. Nos. 4,842,554, 4,842,555, 4,908,335, 5,037,330. The present device provides an improvement over the latter group of connectors described in the aforementioned patents.

U.S. Pat. No. 4,842,554 ('554), discloses a one-piece shield covering four exterior sides of a DIN connector for providing shielding as well as grounding. The obvious disadvantage of this type of connector is that the back or rearward surface of the connector remains exposed to the propagation of electromagnetic interference through the air so that such a connector achieves an imperfect shielding effect.

What is desirable is a five sided shield which would be capable of shielding at least the front face, the top face, two side faces and the back face of a DIN connector. The bottom face of the connector from which the contacts of the connector extend outwardly in order to engage the corresponding apertures on a base such as a printed circuit board, for example, is typically left unshielded because good connection can be made with the base. Moreover, the base itself, such as a printed circuit board, also has a shielding effect.

However, it is difficult and uneconomical from a time and materials standpoint to form a five sided shell by stamping only a single piece of metal. The five sided shell when stretched flat prior to bending, typically forms an irregular outline. That is, it is not a simple matter to obtain a compact layout or arrangement of workpieces for stamping a sheet of metal to form a five sided shell. The process for stamping a five sided shell from a single flat sheet of metal often results in a waste of much of the original sheet of metal because the irregular shapes of metal resulting from the stamping process cannot be recovered for other uses.

In addition, a conventional connector such as that exemplified by the '554 patent is subject to constraints in the assembly process. In the '554 patent, the cantilever fingers extend in a horizontal direction. Thus, it is necessary to assemble the shield to the insulator from the front face. It is not possible for the type of one piece shield as shown in the '554 patent, to be combined with the insulator in any way other than from the front.

It will be appreciated that a conventional one piece shield cannot have five sides formed before assembly with an insulator. In such a case, it would be impossible to combine the shield and the insulator. For a one piece, five sided shield, the only direction from which the insulator can be inserted into the shield is from the bottom. Because the front face of the shield includes fingers which are extended rearward in a horizontal direction, the horizontally extending fingers will prevent the shield from simply being slipped over the insulator.

The rearwardly extending fingers require that the insulator be inserted into the shield from the backside. This is the only direction which would enable the fingers extending from the front face of the shield to be received within the annular recess of the insulator. However, in a conventional one piece, five sided shield, the rear wall would prevent the insulator from being combined with the shield from the back. Thus, a one piece shield such as shown in the '554 patent is incapable of being formed with five sides.

In addition, a conventional one piece shield cannot simply have a rear wall provided in a cantilever configuration prior to assembly, and then bent down to provide a five sided shield covering the rear face of the insulator. The additional step of bending the rear wall during the assembly of the shield to the insulator would unduly complicate the manufacturing process, could possibly damage the insulator and is economically infeasible.

Further, in the '554 patent, only a single piece of metal is used to form the four sided outer shell. The top wall of the shell is formed by bending an edge over the top of the insulator to engage the corresponding edges of the side wall in an edge to edge connection. A gap inevitably exists between the two opposite confronting edges and thus decreases the shielding effect. Other examples of spaces occurring between opposite confronting edges of the shield are shown in the '026 and '664 patents.

Another disadvantage of the conventional shell structure for shielding an electrical connector arises from the rough edges of the inwardly extending contact members. In the manufacturing process of a one piece four sided shield, the contact members extend inwardly from the front opening. These contact members are formed by a bending process so that it is usual to have sharp or rough edges along the inwardly extending contact members. Also, the rough edges of the front opening are exposed to the exterior. This makes the appearance look rough and is undesirable from a customer standpoint. This also causes a mating surface to have a sharp edge which may result in an imperfect connection with another component or in unintentional damage to other components when handling the connector assembly. Additional disadvantages of conventional DIN connectors relate to the need for grounding the connector to prevent the build up of parasitic capacitances and to shunt interfering electromagnetic signals to ground. In a conventional DIN connector, grounding is accomplished by the use of a grounding plate attached to the connector shield and having a connection with an additional grounding means such as a main ground lead for shunting interfering signals to ground as in the case of a computer. As shown in FIG. 1, in a conventional DIN connector 100, the ground plate must be fastened by a pair of screws 110 on the shield 120 and the insulator 130. This has the disadvantage of increasing the number of components for assembly and making assembly time consuming and piecemeal because assembly of the screws is not ordinarily integrated with other assembly steps.

SUMMARY OF THE INVENTION

In order to overcome the foregoing disadvantages of conventional DIN connectors, it is an object of the present invention to provide a two piece five sided shield for completely shielding a DIN connector from electromagnetic interference or the like, and to achieve a superior shielding effect then is possible in conventional devices.

Another object of the present device is to provide high quality shielding at an economic cost by eliminating waste material when the shield pattern is stamped as a layout on a sheet of material due to the even outline of the shield pattern.

A further object of the present device is to provide a completely shielded electrical connector without gaps in the shielding along the edges in order to provide the best possible shielding effect presently obtainable.

Yet another object of the present invention is to provide a shield for a DIN connector wherein the edge of the front opening can be formed through an extrusion process so as to create a smooth circumferential opening without any irregularities or sharp edges. This effectively provides a better mating connection with a plug inserted into the frontal opening.

Still another object of the present invention is to provide a grounding plate which can be secured on the connector through snap engagement and likewise engage the shield, thereby eliminating the need for securing the grounding plate to the shield and insulator by a pair of screws or other fastening means.

In accordance with these and other objects, the present device provides a two piece, five sided completely shielded DIN connector comprising a cuboid insulator body having an annular recess therein extending into a mating face of the connector. A cylindrical portion is positioned within the recess for conformably mating with a corresponding plug connector inserted therein. The cylindrical portion has a plurality of passageways extending therethrough wherein a plurality of corresponding contacts are positioned. A front shell having a front wall and two side walls cover the corresponding faces of the insulator. The front wall defines a circular opening. The edge of the circular opening extends inwardly into the annular recess. A plurality of tangs integral with the front shell extend from the edge of the opening inwardly for engaging the external tubular shell of a corresponding plug connector to be inserted therein.

A rear shell, including a top wall and a rear wall, is positioned behind the front shell covering the corresponding top and rear faces of the insulator. Two pairs of locking means are positioned on the front shell and on the rear shell respectively for combining the two shells together in cooperation with the insulator so as to completely shield the insulator. The front shell also has mounting means projecting from the front wall and the side walls for reception in corresponding holes in a printed circuit board, or the like on which the connector is to be mounted.

Flanges extend from the top wall of the front shell and from the side walls of the rear shell, respectively in order to provide over lapping portions at the interconnection edges formed when the front shell and rear shell are combined to cover the insulator. This assures that no gap occurs along the edges of the front shell or the rear shell in the final combined assembly, and therefore achieves substantially complete shielding against electromagnetic interference.

A locking means includes a pair of receiving sections on the side walls of the front shell and a pair of corresponding insertion ears on the rear wall of the rear shell to engage each other for combining the front and rear shells. A step is also formed on each side face of the insulator to engage the receiving section of the front shell for fastening the front shell to the insulator. In addition, a pair of recesses are positioned on the front face of the insulator for receiving a pair of corresponding hooks of a grounding plate which is positionable against the front wall of the front shell.

DETAILED DESCRIPTION OF THE INVENTION

Figure 1:
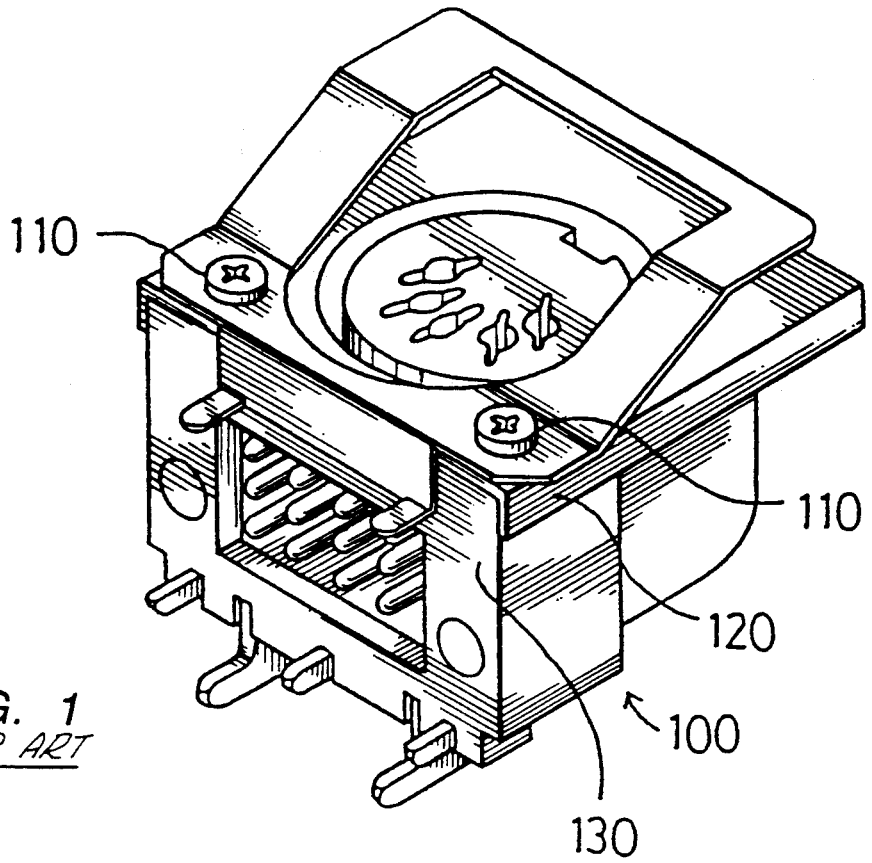
FIG. 1 PRIOR ART
FIG. 1 shows a conventional electrical connector having a grounding plate attached by screws.
Figure 2:
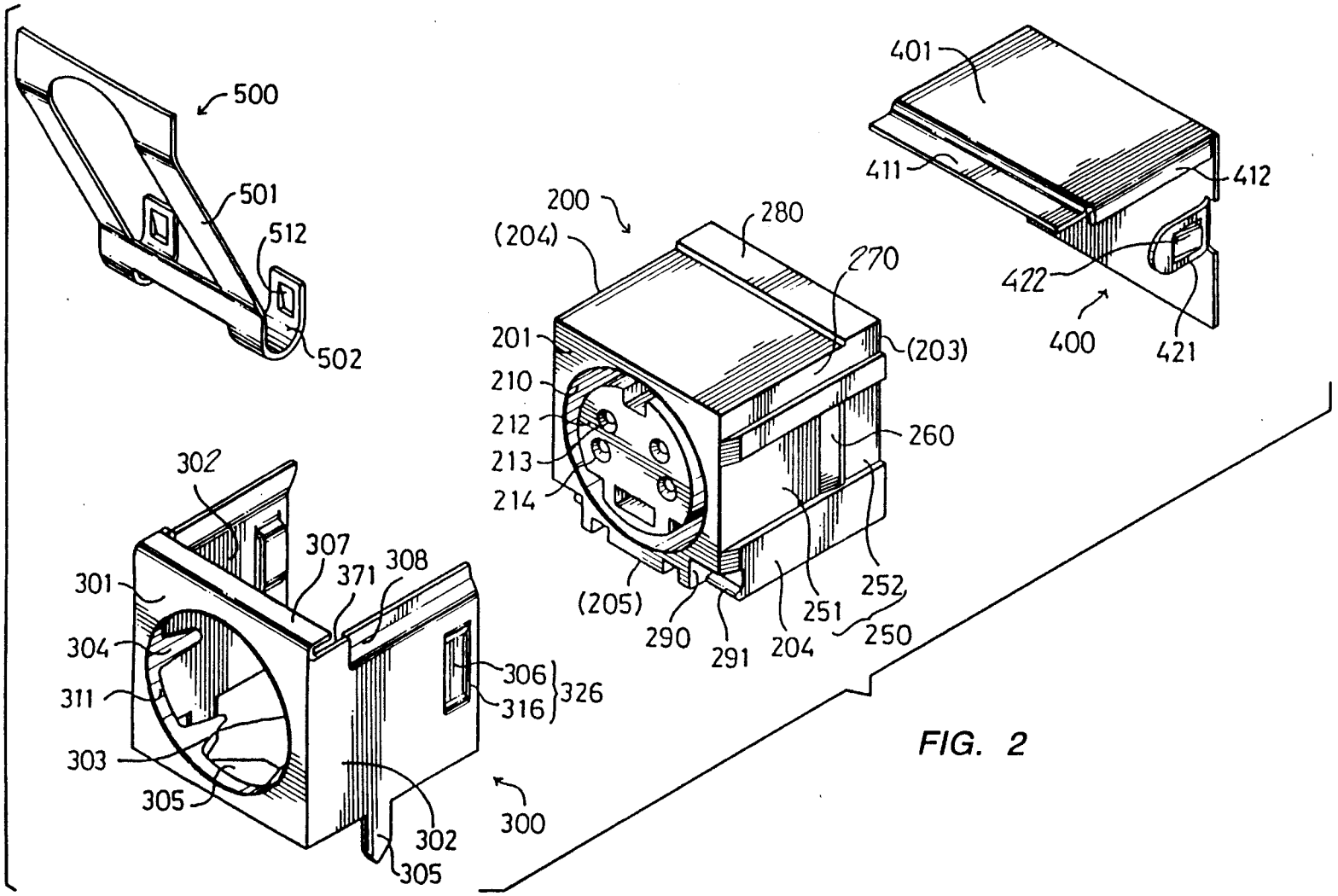
FIG. 2 is an exploded perspective view of a presently preferred embodiment of a totally shielded connector in accordance with the present invention.

Referring now to FIG. 2, the connector assembly according to the present invention includes an insulator 200 having a cubic body comprising a front face 201, a top face 202, a rear face 203, two side faces 204, and a bottom face 205. The configuration of the connector assembly according to the present invention is not limited to a cube with six equal, square sides. The present connector assembly also can have a rectangular front face. Thus, the terms "cubic" or "cuboid" as used herein are intended to include a polygonal structure. An annular recess 210 extends to front face 201 of the insulator 200 such that a cylindrical portion 212 is defined by the recess 210 for mating with a corresponding plug connector (not shown). A plurality of passageways 213 extend through the cylindrical portion 212 and include a plurality of corresponding contacts 214 therein, each for contacting a corresponding plug of a plug connector. As is known to one skilled in the art, the contacts 214 have their tails bent at a right angle with respect to the bottom face 205 (refer to FIG. 1) in order to enable the contacts to be mounted in corresponding receptacles on a printed circuit board, or the like.

A U-shaped front shell 300 includes a front wall 301 and two side walls 302 for covering the corresponding front and side faces of the insulator 200. The front wall 301 includes a circular recess or opening 303 of which an edge 311 thereof extends inwardly a certain distance such that no sharp edge is exposed to the outside when the front shell 300 is engaged with the insulator 200. A plurality of tangs 304 extend inwardly from the edge 311 for mating an external conductive shield of a corresponding plug connector (not shown). Three grounding legs 305 project from the front wall 301 and the side walls 302 for reception in corresponding holes in a base such as a printed circuit board, or the like on which the connector is to be mounted.

Locking means are provided for engageably combining the front and rear shells and for securing the combined front and rear shells to the insulator body 200. Cooperating with the insulator body 200, an inward projection 306 is disposed on the rear portion of each side wall 302. A pair of slits 316 are formed between the projection 306 and the side wall 302. The pair of slits 316 formed between the projection 306 and side wall 302 together comprise a receiving section 326.

A flange 307 extends rearwardly from the upper edge of front wall 301, and a space 317 is formed between the flange 307 and the upper edge of the side wall 302. Along the upper edge of each side wall 302, a portion of its length is split inwardly to form an offset 308.

To cooperate with the front shell 300 for enclosing five sides of the insulator body 200, an L-shaped rear shell 400 includes a top wall 401 and a rear wall 402 to be disposed over the insulator 200 for covering the remaining corresponding faces of the insulator 200. A pair of insertion ears 421 extend forwardly from the side edges of the rear wall 402 of rear shell 400. Each insertion ear 421 includes a tab 422 projecting outwardly for engaging the corresponding receiving section 326 of front shell 300. An offset surface 411 is disposed at the front edge of top wall 401 for overlapping with the corresponding flange 307 of the front wall 301 of the front shell 300. Similarly, a pair of flanges 412 extend downwardly from each side edge of top wall 401 for overlapping with the offset 308 of the side walls 302 of the front shell 300.

To cooperate with the two shells 300 and 400, a corresponding groove 250 is disposed on each side face 204 of the insulator 200. The groove 250 is divided by a step 260 to form two separate grooves 251 and 252 respectively. Another groove 270 is disposed along the upper edge of each side face 204. Also, a step 280 is formed on the rear portion of top face 202 of the insulator 200.

A selected component, such as a grounding plate 500 can be attached to the connector assembly. The grounding plate 500 has a square frame body 501 and a pair of U-shaped hook legs 502 disposed at opposite ends of the lower portion of the frame body 501. Each of the hook legs 502 has a tab portion 512 projecting outwardly therefrom. The upper portion of the frame body 501 is disposed at an oblique angle in a forward direction. To receive the hook legs 502 of the grounding plate 500 and the tabs 512 thereon, the insulator 200 has a pair of recesses 290 and a pair of steps 291 positioned at the front and bottom corners thereof.

When assembling the connector assembly, initially the front shell 300 is pushed rearwardly from the front over the insulator 200. The offsets 308 move rearwardly along corresponding grooves 270 in the insulator 200. Similarly, the projections 306 of the side wall 302 conformably move along the corresponding grooves 251 in the side of insulator 200.

Consecutively, the tangs 304 are inserted into the annular recess 210 and the edge 311 of the aperture 303 is embedded in the annular recess 210 at a proper depth. At the same time, the projections 306 go over the steps 260 and fit conformably into the grooves 252 without the possibility of withdrawal. Secondly, the rear shell 400 is positioned on the insulator 200 from the rear. The offset surface 411 moves along the top face 202 of the insulator 200 and the flanges 412 move conformably along the outer surfaces of the offsets 308 of the front shell 300 to form a tight fit. Consequently, the front edge of each insertion ear 421 passes through the first corresponding slit 316 and sequentially through the second slit until the rear wall 402 confronts the rear face 203 of the insulator 200. At this time, the tabs 422 spring resiliently outward after having been depressed during the insertion process, and abut against the opposite edges of the corresponding receiving sections 326 so that the front shell 300 and the rear shell 400 are firmly combined together.

Figure 3:
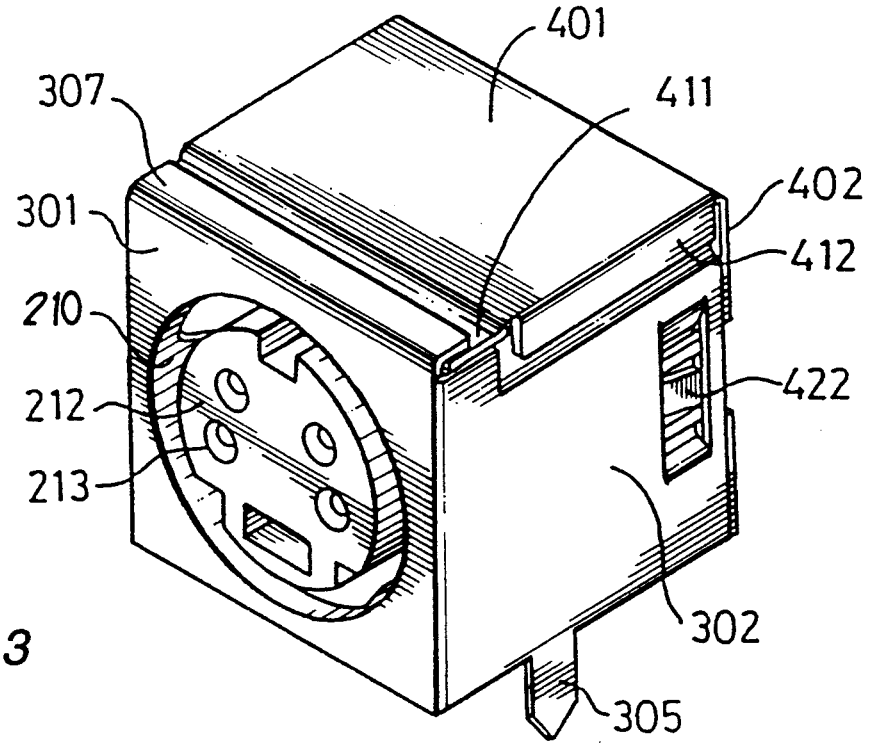
FIG. 3 is a perspective view of the assembly of FIG. 2 without the grounding plate.

Also, the offset surface 411 of the rear shell 400 is pushed into the space 371 to overlap with the flange 307 of the front shell 300. The standoff or step 28 then can support the rear portion of the top wall 401 of the rear shell 400, and retains the rear shell 400 firmly in position without any tilting or deformation. Additionally, the grounding plate 500 is selectively mounted on the front shell 300 by inserting the hook legs 502 into the corresponding recess 290 wherein tab 512 abut against the steps 291. The final assembled connector is shown in FIG. 3.

It will be appreciated that through the two piece structure as described, the present device provides a five sided shield for total shielding against electromagnetic interference, or the like. The bottom face of the insulator 200 is shielded by the printed circuit board or the like on which the connector is mounted. The totally shielded connector provided by the present device is preferred by customers when it is necessary to provide superior shielding against electromagnetic interference. The present device is especially suited for applications wherein it is extremely important to substantially eliminate the effects of electromagnetic interference such as in sensitive medical diagnostic equipment, aircraft navigational systems, or the like.

It is appreciated that the present invention affords a novel shielding structure without any spaces along the edges of the shield. The edge to edge connection between the front shell and s the top wall of the rear shell is enhanced by an overlapping structure. This substantially eliminates all points of entry for electromagnetic interference, and provides a much improved shielding effect as compared to conventional devices using a simple edge to edge connection.

Advantageously, an extrusion process is applied to the circular aperture 303 of front shell 300 such that the edge 311 of the opening 303 of the front shell 300 extends into the corresponding annular recess 210 of the insulator 200. This ensures that no sharp edge is exposed to the exterior. This also results in a smooth appearance and a much improved shielding effect when mating the present connector with the external shield of a plug connector.

The present device provides an additional advantage over conventional connectors in that the grounding plate can be selectively mounted on the selector my means of a snap engagement mechanism without using any tools or additional components such as screws or other fastening means.

While the invention has been described in connection with what is presently considered to be the most practical and preferred embodiments, it is to be understood that the invention is not limited to the disclosed embodiment but, on the contrary, is intended to cover various modifications and equivalent arrangements included within the spirit and scope of the appended claims. For example, a reverse design can be applied to the front shell and rear shell by using a front shell including the front wall and the top wall, and using a rear shell including the side walls and a rear wall. Also, the complimentary structures such as flanges and offsets can be applied to the opposite edges of any interconnection portions of these two shells. Further, the front shell and the rear shell can be fixed on the insulator separately instead of being fastened to each other. Furthermore, the insulator can be a dual port type accompanying the front shell and the rear shell. This configuration would have a rectangular front with two annular recesses provided in the front surface for receiving two corresponding plug connectors, respectively.

Therefore, persons of ordinary skill in this field are to understand that all such equivalent structures are to be included within the scope of the following claims.

What is claimed is:

1. A totally shielded connector comprising:

a cuboid insulator having a front face, a top face, two side faces, a rear face, and a bottom face, said insulator defining an annular recess extending from the front face, and including a cylindrical portion, disposed within the annular recess, having a plurality of passageways extending therethrough for receiving a plurality of corresponding contracts;

a front shell, including a front wall and side walls, positioned on the insulator to cover the front face and the side faces of the insulator, the front wall having a circular opening defining an edge from which a plurality of tangs project into said annular recess;

a rear shell, including a top wall and a rear wall, positioned on the insulator to cover the top face and the rear face of the insulator such that the front shell cooperates with the rear shell to form a five sided shield for totally shielding the connector, the side walls of the front shell having a projection to cooperate with a corresponding groove and a step disposed on each side of the insulator for engagement therewith, the rear wall having an insertion ear to engage a slit formed between the projection and the side walls of the front shell for fastening, and the insertion ear further including a tab projecting outwardly for engaging an edge of the side wall when fastened.

2. The connector as described in claim 1 wherein a grounding means projects from the front shell for reception in a base on which the connector is to be mounted.

3. The connector as described in claim 1 wherein the edge of he circular opening of the front shell is extruded inwardly for conformably contacting the annular recess.

4. A totally shielded connector comprising:

a cuboid insulator having a front face, a top face, two side faces, a rear face, and a bottom face, said insulator defining an annular recess extending from the front face, and including a cylindrical portion, disposed within the annular recess, having a plurality of passageways extending therethrough for receiving a plurality of corresponding contacts;

a front shell, including a front wall and side walls, positioned on the insulator to cover the front face and the side faces of the insulator the front wall having a circular opening defining an edge from which a plurality of tangs project into said annular recess;

a rear shell, including a top wall and a rear wall, positioned on the insulator to cover the top face and the rear face of the insulator such that he front shell cooperates with the rear shell to form a five sided shied for totally shielding the connector; and an offset formed proximally to an edge of each side wall that cooperates with a flange depending from each side of the top wall for overlapping engagement.

5. The connector as described in claim 4 wherein a flange extends from an edge of the front wall of said front shell to cooperate with an offset of the top wall of said rear shelf or overlapping engagement.

6. The connector as described in claim 4 wherein the side faces of the insulator each include a groove disposed parallel to the edges hereof for receiving he corresponding offset of a respective said side wall.

7. The connector as described in claim 5 wherein a step is positioned on the top face of the insulator for compensating the offset of the top wall.

8. A five sided shield connector comprising:

a polygonal insulator body having a front face, a top face, two side faces, a rear face, and bottom face;

an annular recess extending from the front face inwardly to define a cylindrical portion of said insulator for engaging a corresponding plug connector;

a U-shaped front shell covering the front face and the side faces of the insulator and having a circular opening for receiving the plug connector;

an L-shaped rear shell covering the top face and the rear face of the insulator;

locking means including a receiving section and a corresponding insertion ear positioned on the front shell and the rear shell, respectively, for engageably combining the front and rear shells and thereby forming a combined front shell and rear shell;

a plurality of passageways extending through the cylindrical portion for receiving a plurality of corresponding contacts of a plug connector inserted therein;

a plurality of tangs extending from the circular opening that extend inward for engagement with an external shield of said plug connector; and a plurality of grounding means extending from the combined front shell and rear shell for securing the combined front shell and rear shell to a base, wherein the insulator includes means for cooperating with the locking means for combining the front shell and the rear shell for fastening the combined front and rear shell of the front shell and the rear shell to said insulator, and wherein the means for fastening he combination of the front shell and the rear shell includes a tab means extending outwardly from said rear shell for engageably locking against a corresponding receiving section of said front shell.

9. The connector as described in claim 8 wherein a flange on the front shell engages a corresponding congruently disposed offset in the rear shell to form an overlapping interconnection between the front shell and the rear shell.

10. The connector as described in claim 9 wherein a grounding plate is engageably positioned on the front shell and wherein said grounding plate includes means for mounting to the insulator.

11. The connector as described in claim 10 wherein the grounding plate has an opening for receiving a corresponding plug connector and a hook leg for insertion within a corresponding recess of the insulator, and wherein the grounding plate contacts a base such as a computer chasis when assembled to provide a complete grounding effect.

12. A total shielded connector comprising:

a cuboid insulator having a front face, a top face, two side faces, a rear face, and a bottom face, said insulator defining an annular recess extending from the front face, said insulator including a cylindrical portion disposed within said annular recess having a plurality of passageways extending therethrough for receiving a plurality of corresponding contacts;

a front shell including a front wall and side walls, said front shell being formed of a single piece of conductive material and being positioned on said insulator to cover said front face and said side faces of said insulator, said front wall having a circular opening defining an edge from which a plurality of tangs project into said annular recess;

a rear shell including a top wall and a rear wall, said rear shell being formed of a single piece of conductive material and being positioned on said insulator to cover the top face and the rear face of the insulator, said rear shell being formed so that it cooperates with said front shell to form a five sided shield for totally shielding the connector; and means for grounding said five sided shield, said grounding means projecting from said side walls of said front shell for reception in a base on which said connector is to be mounted.

* * * * *